United States Patent [19]

Garrigue et al.

[11] Patent Number: 4,773,962

[45] Date of Patent: Sep. 27, 1988

[54] DEVICE FOR MOISTENING THE CLOSURE FLAPS OF ENVELOPES

[75] Inventors: André Garrigue, Courbevoie; Marek Krasuski, Fontenay Aux Roses, both of France

[73] Assignee: SMH Alcatel, Paris Cedex, France

[21] Appl. No.: 113,349

[22] Filed: Oct. 28, 1987

Related U.S. Application Data

[63] Continuation of Ser. No. 852,685, Apr. 16, 1986, abandoned.

[30] Foreign Application Priority Data

Apr. 16, 1985 [FR] France ..... 85 05700

[51] Int. Cl.[4] ..... B43M 5/04

[52] U.S. Cl. ..... 156/441.5; 118/259; 118/264; 118/266; 156/442.1; 156/442.2; 156/442.4

[58] Field of Search ..... 156/441.5, 442, 442.1, 156/442.2, 442.3, 442.4; 118/258, 259, 262, 264, 266, 429, 312, 31, 602; 417/476, 474

[56] References Cited

U.S. PATENT DOCUMENTS

| | | | |
|---|---|---|---|
| 802,930 | 10/1905 | Friede | 156/442.1 |
| 988,713 | 4/1911 | Jackson | 156/442.1 |
| 1,090,771 | 3/1914 | White | 156/442.2 |
| 1,146,746 | 7/1915 | Albrecht | 156/442.1 |
| 1,593,867 | 7/1926 | Cleveland . | |
| 1,925,653 | 9/1933 | Byerley . | |
| 2,015,507 | 9/1935 | Arnold et al. | 156/442.1 |
| 2,113,738 | 4/1938 | Morrison . | |
| 2,224,496 | 12/1940 | Wild | 156/453 X |
| 2,609,790 | 9/1952 | Uhl . | |
| 3,209,725 | 10/1965 | Besenick | 118/260 |
| 3,303,815 | 2/1967 | Silver | 118/259 |
| 4,183,321 | 1/1980 | Ziegelmeyer | 118/259 |

FOREIGN PATENT DOCUMENTS

| | | | |
|---|---|---|---|
| 00484520 | 10/1929 | Fed. Rep. of Germany . | |
| 0004021 | of 1913 | United Kingdom | 156/442.1 |
| 1118803 | 10/1984 | U.S.S.R. . | |

*Primary Examiner*—Michael W. Ball
*Assistant Examiner*—Jeff H. Aftergut
*Attorney, Agent, or Firm*—Sughrue, Mion, Zinn, Macpeak, and Seas

[57] ABSTRACT

The device for moistening the flaps of envelopes as they are driven along a substantially horizontal plane comprises a substantially vertical brush (1) caused to rotate with a peripheral speed substantially equal to the speed at which the envelopes are driven, and fed with moistening liquid taken from a tank (3) by means of a peristaltic pump (4), with the envelope flaps being pressed against the brush by means of a deflector (2).

6 Claims, 4 Drawing Sheets

DEVICE FOR MOISTENING THE CLOSURE FLAPS OF ENVELOPES

This is a continuation of application Ser. No. 852,685, filed 4/16/86, now abandoned.

The present invention relates to devices for moistening closure flaps of envelopes, for use in particular in automatic mail processing installations, and more particularly for use in franking machines with which they may be associated.

BACKGROUND OF THE INVENTION

When sealing envelopes, moisture must be applied to the gummed regions of their flaps in a manner which is quick and reliable, and independent of the types and formats of the envelopes. Advantageously, this moistening operation should be performed while the envelopes are being transferred from the outlet of an envelope un-stacking device which serves to feed envelopes one by one with their flaps open to the inlet of a franking machine. In addition to operating reliably and rapidly, such moistening devices must also leave sufficient moisture on the envelope flaps to ensure that they are properly sealed while avoiding the application of too much moisture in order to avoid drops and smudges forming while the envelopes are being sealed.

Several prior devices for moistening envelope flaps are already known. They comprise a tank of moistening liquid (generally water) and a moistening member having a first portion which extends some way into the liquid tank and a second portion which "licks" the flap of each envelope. The envelope flaps are thus moistened as they are driven in a flat position over the moistening device on a displacement mechanism or plane having an edge beyond which the envelope flaps are caused to hang freely. In order to ensure that liquid is effectively transferred to the flaps, they are pressed against the moistening member by means of a spring-biased deflector plate or the like disposed opposite the moistening member.

One such device for moistening envelope flaps is described in French published patent application No. 2 332 813. In this device, the moistening member is constituted by an endless belt which is driven to transfer the moistening liquid from the liquid tank to the envelope flaps as the flaps pass close to the belt and are pressed thereagainst over the full lengths of their gummed portions.

Another such a moistening device is described in published French patent application No. 2 195 532, in which the moistening member constituted by a wick held on a wick support arm and having one of its ends immersed in the liquid in the tank and having its other end in the form of an elongate wetting portion standing out from the support arm. In this embodiment moisture is transferred along the wick by capillarity in the wick-constituting material, and the flap is moistened by rubbing against the end wetting portion of the wick. It is difficult to regulate the transfer of moisture from the end wetting portion of the wick to the gummed flaps of the envelopes in this kind of device. The transfer depends on the force with which the flaps are pressed against the wetting portion of the wick, and this force is itself a function of the thickness of the envelope flaps, which may mean that the flap of a thin envelope is insufficiently moistened while the flap of a thick envelope is excessively moistened, and which may also give rise to the envelopes being damaged by virtue of their flaps being slowed down.

Such friction also causes gum to be transferred from the flaps to the wetting portion of the wick, and in the course of time this can give rise to uneven transfer of moisture to envelope flaps. The transfer of moisture to envelope flaps also depends on the transfer of moisture along the wick itself, which transfer is obtained by capillarity in the wickconstituting material, and is therefore sensitive to the use of hard water as the moistening liquid (which is quite common). Furthermore, in this prior embodiment the amount of moisture transferred to the flaps varies along the length of the flaps, giving rise to problems with long envelope flaps, whose leading ends may be excessively moistened, and whose trailing ends may be insufficiently moistened.

Preferred implementations of the present invention seek to provide a moistening device which avoids the above-mentioned drawbacks by providing uniform moistening of envelope flaps regardless of their speed of displacement and of their lengths, furthermore this is achieved with practically no risk of damaging the envelopes and without the amount of moistening liquid transferred changing appreciably over time.

SUMMARY OF THE INVENTION

The present invention provides a device for moistening the closure flaps of envelopes as they are displaced longitudinally along a substantially horizontal path, the device comprising:

a moistening member disposed beneath said path, said moistening member being constituted by a cylindrical liquid transfer brush rotatably mounted on a substantially vertical shaft;

a deflector disposed adjacent to said brush to press envelope flaps against an envelope-moistening zone of said brush;

a tank of moistening liquid for said brush, said tank being located at a distance from said brush; and liquid feed means for feeding said brush with liquid from said tank, said brush being fed in a brush feed zone which is located downstream from said envelope-moistening zone.

The periphery of said brush may be driven at a peripheral speed substantially equal to the speed at which said envelopes are displaced.

Said liquid transfer brush may have a plurality of grooves at intervals up its height, and said deflector may be provided with a plurality of ribs on its face facing said brush, said ribs engaging in said brush grooves.

Said liquid feed means may comprise a peristaltic pump, and a liquid spreading cylinder may be pressed against the periphery of the brush between its feed zone and its envelope-moistening zone.

BRIEF DESCRIPTION OF THE DRAWINGS

An embodiment of the invention is described, by way of example, with reference to the accompanying drawings, in which.

MORE DETAILED DESCRIPTION

Figure 1:
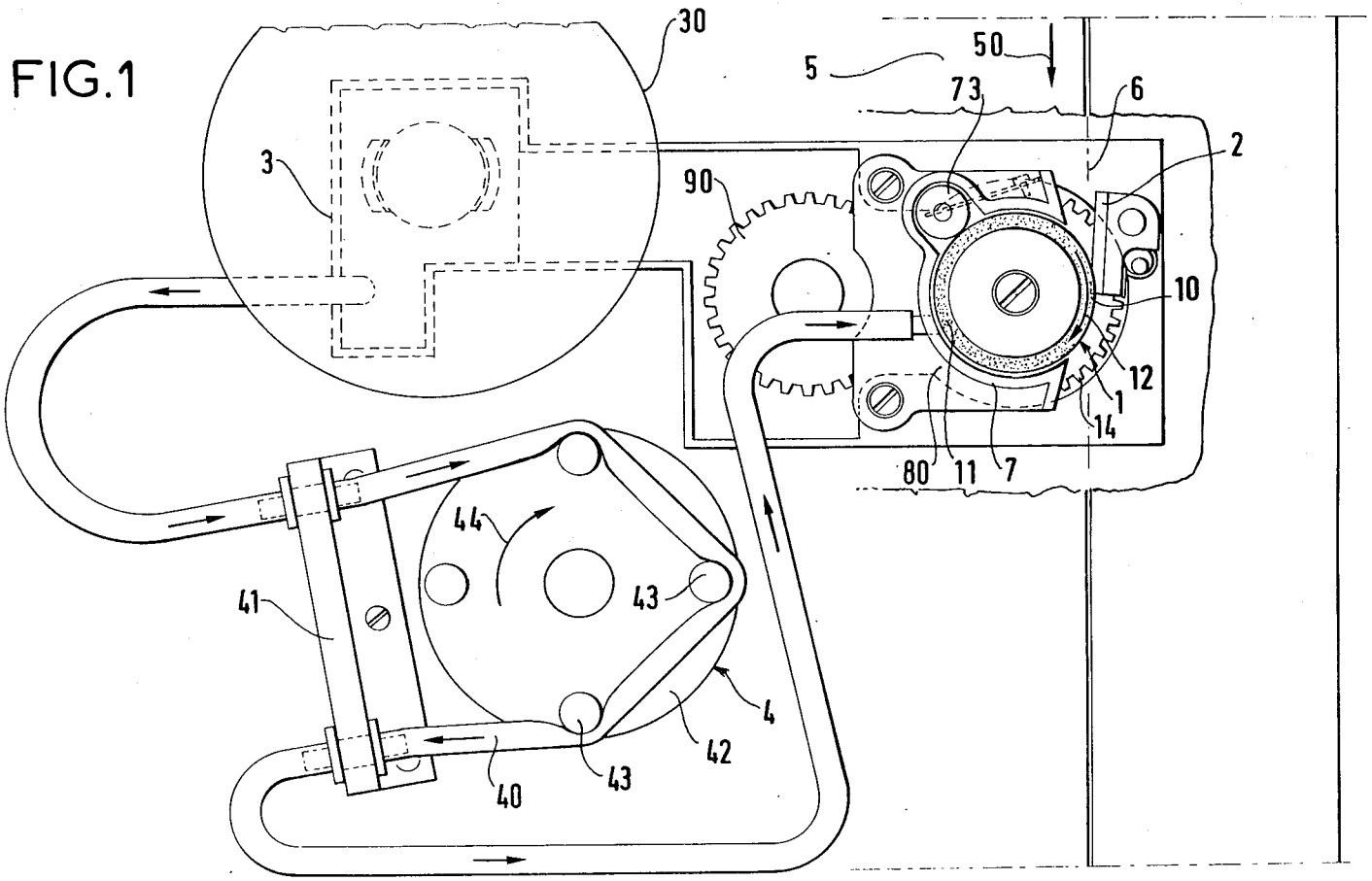
FIG. 1 is a diagrammatic view of a moistening device in accordance with the invention.

With reference to FIG. 1, it can be seen that a moistening device in accordance with the invention comprises a rotating vertical brush or moistening roller 1, a deflector 2 facing the brush, a tank 3 of moistening liquid (in particular water), which tank is at a distance from the brush, and a peristaltic pump 4 for providing a regulated water feed to the brush from the tank. A water bottle 30 keeps the tank 3 supplied with water.

This device is mounted beneath a substantially horizontal plane defined by a plate 5 over which the bodies of envelopes are driven lengthwise in the direction of arrow 50. The envelope flaps hang down in a vertical plane referenced 6 and are received between the brush 1 and the deflector 2, thereby enabling water to be transferred to the gummed faces of the flaps. This water transfer takes place from a vertical envelope flap-moistening zone 10 of the brush against which the flaps are pressed by the deflector as the envelopes move horizontally. This moistening zone 10 engages an end portion of the deflector which partially interfits with the brush, as described below with reference to FIGS. 3 and 4.

The brush 1 is fed with water by the peristaltic pump 4 which has a tube 40 for taking water from the tank 3 and delivering water to the brush 1. This tube is flexible and has an intermediate portion extending between a pump inlet and a pump outlet which are fixed to a fixed support 41. This intermediate portion is in the form of an open loop extending over a horizontal plate 42 which constitutes the pump rotor and which has vertical axis wheels 43 mounted at its periphery and left free to rotate relative to the rotor. The wheels are distributed in such a manner that there is always a plurality of said wheels simultaneously exerting sufficient force on said intermediate portion of the tube 40 to compress and close its bore. As the rotor turns in the direction indicated by arrow 44, successive mutually closed lengths of tube are moved round said open loop by successive wheels 43, thereby moving known volumes of water along the tube. The rate at which water is taken from the tank 3 and applied to the brush 1 is thus determined by the speed of rotation of the pump 4.

Figure 2:
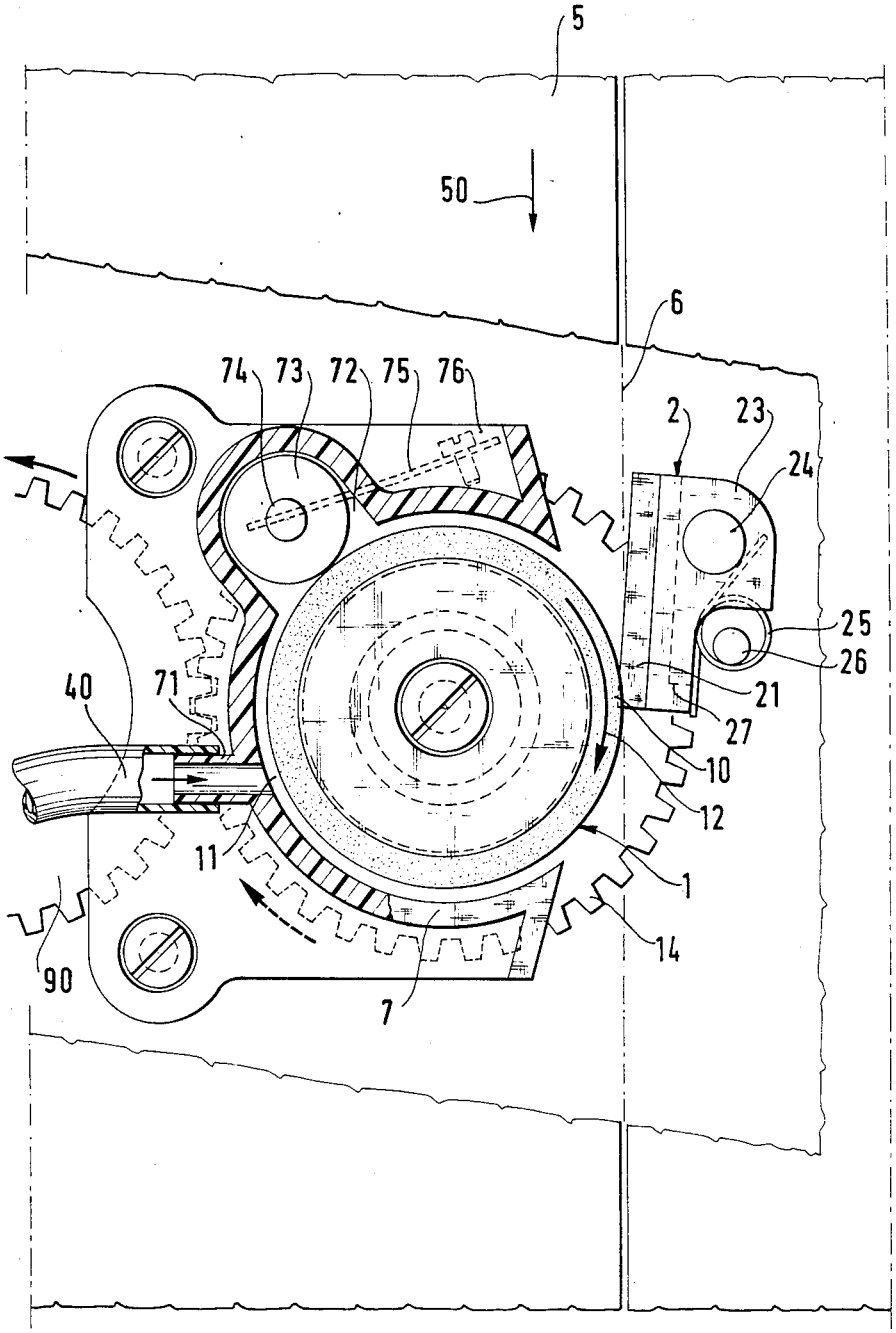
FIG. 2 is a plan view on a larger scale showing a portion of the FIG. 1 device.

As can be seen in FIG. 1, and as is shown more clearly in FIG. 2, the water delivery end of the tube 40 opens out adjacent to a feed zone 11 on the brush periphery, which zone is substantially opposite to the moistening zone 10 of the brush. The tube 40 is fixed to a brush housing 7 which is open around its moistening zone 10 and in the immediate vicinity thereof in order to allow envelope flaps to pass over the brush. The housing therefore extends over slightly more than a semicylinder. An outwardly projecting inlet duct 71 is provided near the top of the housing level with the top end of the brush, and the outlet end of the water feed tube 40 is fitted thereto.

Downstream from the duct 71 (where "downstream" is defined with reference to the direction of brush rotation and shown by arrow 12), the housing 7 includes a second generally semicylindrical portion 72 for a water-spreading cylinder 73 for spreading water along the height of the brush. The cylinder 73 is mounted on a vertical shaft 74. The shaft 74 is resiliently urged towards the brush 1 by means of a spring blade 75 so that the cylinder 73 is pressed against the periphery of the brush. The cylinder is free to rotate about the shaft 74 and the ressure it exerts on the brush spreads the water properly over the entire length of the brush.

The top and bottom ends of the housing 7 are closed by end plates 76 (with the top end plate being visible only in FIG. 1 and with the bottom end plate being visible only in FIG. 2). The bottom end plate 76 constitutes a base by which the housing 7 is fixed to a bottom plate 8 on which the device is supported. It also serves, in conjunction with the top end plate, to hold the spreading cylinder 73 in the housing.

Figure 3:
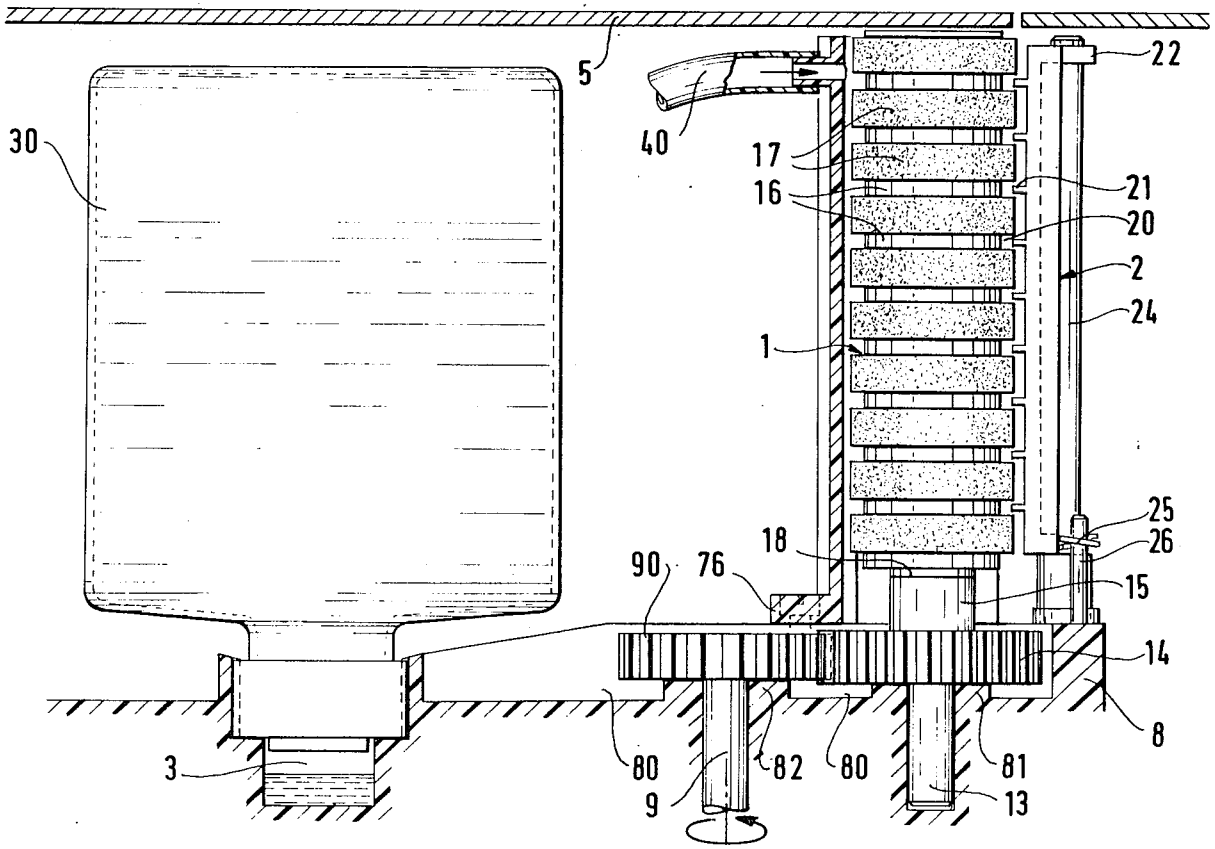
FIG. 3 is an elevation of the FIG. 1 device shown in partial section on line III—III of FIG. 1.

As can be seen in FIG. 1, but is shown in greater detail in FIG. 3, the bottom plate 8 is shaped to define a gutter 80 underneath the brush 1 and its housing 7, which gutter is suitable for collecting water which may drip down, in particular from the feed zone and from the zone in which water is spread vertically. The gutter 80 slopes towards the tank 3 which is formed directly in the bottom plate, and opens out into said tank.

With reference to FIG. 3, it can be seen that the bottom plate 8 also has first and second projections 81 and 82 standing proud from the bottom of the gutter 18, with a driven shaft 13 passing through the first projection 81 and a drive shaft 9 passing through the second projection 82. The drive shaft 9 is coupled to rotate the brush 1 via two gear wheels 90 and 14 which are mounted on the shaft 9 and the brush 1 respectively and which mesh with each other beneath the bottom end plate 76 of the housing 7. Advantageously, the brush is driven so that its peripheral speed is substantially equal to the speed of envelope displacement, thereby avoiding rubbing against the envelopes and hence avoiding distorting the envelopes.

Although not visible in the figures, the pump may be driven from the same drive shaft 9 by means of suitable gearing.

Figure 4:
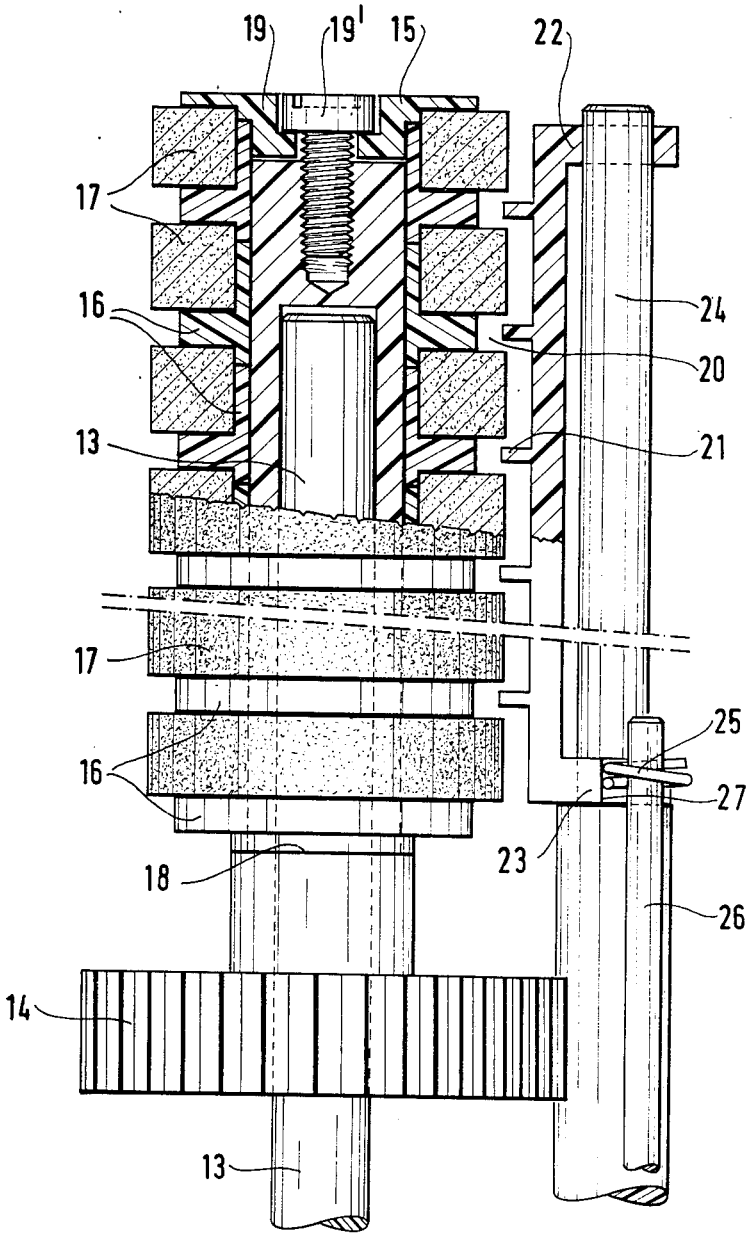
FIG. 4 is an elevation in partial section through one of the components of the device.

The brush 1 is described below with reference to FIGS. 3 and 4, and the deflector which is associated therwith is described with reference to FIGS. 3 and 4, and also with reference to FIGS. 1 and 2.

The brush 1 has a hub 15, a stack of plastic rings 16 mounted on the hub, and a plurality of foam rings 17 maintained offset from one another between said plastic rings 16 which serve as spacers. The gear wheel 14 is mounted at one of the ends of the hub 15. A shoulder 18 is provided on the hub 15 close to said end and at a different axial position along said hub to the gear wheel 14 and to the stack of plastic rings. The stack of rings is held on the hub 15 by means of a top button 19 which is held in place by an axially extending screw 19' received in an axial tapped bore in the hub.

Each of the plastic rings 16 has an outwardly extending central rib defining oppositely directed shoulders which press against and retain the foam rings 17, with each of the foam rings being received between two successive plastic rings. The peripheries of the foam rings 17 extend radially beyond the peripheries of the central ribs of the plastic rings, so that the ribs lie in gaps between the foam rings. A series of grooves 20 is thus defined at intervals up the brush 1.

The deflector 2 is constituted by a plate which is advantageously made of plastic and which extends substantially over the entire height of the brush. On its face facing the brush, the deflector has a set of ribs 21 which partially project into the grooves 20 between successive foam rings of the brush in the moistening zone of the brush. The ribs 21 as engaged in the grooves 20 ensure good uniform contact between the flap of each envelope and the brush in the moistening zone.

The bottom and top edges of the deflector 2 have respective fastening lugs 22 and 23 which point away from the brush 1. These lugs fasten the deflector on a vertical shaft 24 on the opposite edge of the deflector from the edge which meshes with the moistening zone. The shaft 24 is fixed to the bottom plate 8. The deflector is free to rotate about its shaft 24 within limits set by abutments, and is resiliently urged about said shaft by a spring 25 which is wound round a vertical peg 26 which is fixed to the support plate 8. The terminal portions of the spring 25 press against the shaft 24 and a shoulder 27 formed in the bottom fixing lug 23. This resilient mounting of the deflector between its abutments enables its ribs to be inserted into the brush grooves by an amount which is adaptable, within limits, to the thicknesses of envelope flaps.

In operation, the brush is fed with a sufficient quantity of water to moisten the envelopes. This makes the device operate reliably regardless of the speed at which envelopes are displaced, the rate at which envelopes are applied thereto, or the lengths of the envelopes. The drive applied by the brush 1 to the envelope flaps is at substantially the same speed as the drive applied to the envelope bodies, thereby reducing the risks of the envelopes being damaged or of gum being removed from the flaps, and thus contributing to the overall reliability of the device. In addition, since the envelope flaps are pressed against the brush by means of the ribs which would otherwise penetrate into the grooves of the brush, there is no danger of the brush being worn or of water being transferred to the deflector itself in the absence of an envelope flap since there is no direct contact between the deflector and the moistened foam portions of the brush. In other words, the ribs hold the deflector off the moist foam rings 17.

In addition, the device in accordance with the invention is particularly easy to assemble and maintain and there is no risk of its spilling water into the remainder of the machine of which it forms a part.

We claim:

1. A device for moistening closure flaps of envelopes as the envelopes are displaced longitudinally along a substantially horizontal path with the flaps projecting vertically downwardly, the device comprising:

a moistening member disposed beneath said path, said moistening member being constituted by a moistening roller rotatably mounted on a substantially vertical shaft for rotation about a vertical axis, said moistening roller comprising a plurality of axially spaced, radially projecting rings of absorbent foam;

a deflector disposed adjacent to said moistening roller to press envelope flaps against the periphery of said moistening roller and forming an envelope flap-moistening zone, said deflector including a series of spaced ribs projecting partially between respective absorbent foam rings of said moistening roller, but spaced therefrom in said envelope flap-moistening zone to limit contact with said moistening roller in said flap-moistening zone to said closure flaps of said envelopes;

a tank of moistening liquid for said moistening roller, said tank being located at a distance from said moistening roller;

liquid feed means for feeding liquid to said moistening roller at the vertical upper end of said moistening roller to facilitate liquid distribution over all of the rings of absorbent foam from said tank at a liquid feed zone which is located downstream with respect to the direction of rotation of said moistening roller from said envelope flap-moistening zone, drive means coupled to said shaft for causing the periphery of said moistening roller to be driven at a peripheral speed substantially equal to a speed at which the envelopes are displaced, to prevent distortion of the envelopes during flap moistening; and moisture spreading means pressed against the periphery of said moistening roller between said liquid feed zone and said envelope flap-moistening zone to spread the liquid properly over the entire length of the moistening roller absorbent foam rings.

2. A device according to claim 1, wherein said liquid feed means is constituted by a regulated flowrate pump.

3. A device according to claim 2, wherein said pump is a peristaltic pump operating on a feed tube for said moistening roller, said tube having an outlet disposed to apply liquid to a top absorbent foam ring of said moistening roller.

4. A device according to claim 2, wherein said moistening roller is constituted by a stack of first shouldered rings on a hub and by said plurality of foam rings projecting radially outwardly of said first rings between which they are held offset from one another along the length of the moistening.

5. A device according to claim 1, wherein said moistening roller and said deflector are mounted on a base plate which includes a gutter for receiving the moistening liquid, said gutter extending at least beneath said moistening roller.

6. A device according to claim 5, wherein said gutter is in the form of an inclined slope and opens out into said tank.

* * * * *